United States Patent [19]

Berchoux

[11] Patent Number: 4,529,321

[45] Date of Patent: Jul. 16, 1985

[54] DEVICE FOR THE PREPARATION OF DISPERSIONS

[75] Inventor: Andrè Berchoux, Couzon-au-Mont d'Or, France

[73] Assignee: Rhone-Poulenc Textile, Paris, France

[21] Appl. No.: 479,186

[22] Filed: Mar. 28, 1983

Related U.S. Application Data

[63] Continuation of Ser. No. 229,504, Jan. 29, 1981.

[30] Foreign Application Priority Data

Feb. 13, 1980 [FR] France ..... 80 03217

[51] Int. Cl.[3] ..... B01F 15/02

[52] U.S. Cl. ..... 366/177; 366/157; 366/317

[58] Field of Search ..... 366/150, 155, 156, 157, 366/168, 177, 173, 172, 317

[56] References Cited

U.S. PATENT DOCUMENTS

| | | | |
|---|---|---|---|
| 2,559,516 | 7/1951 | Russell | 366/177 |
| 2,658,049 | 11/1953 | Adams | 366/180 X |
| 3,266,781 | 8/1966 | Eppenberger | 366/157 |
| 3,320,639 | 5/1967 | Harp | 366/156 X |
| 3,423,075 | 1/1969 | Knudsen et al. . | |
| 3,682,447 | 8/1972 | Zucker et al. | 366/157 |
| 3,923,289 | 12/1975 | Danberg . | |
| 4,106,117 | 8/1978 | Cloots | 366/180 X |
| 4,176,972 | 12/1979 | Stiling . | |

FOREIGN PATENT DOCUMENTS

| | | | |
|---|---|---|---|
| 2951311 | 7/1981 | Fed. Rep. of Germany | 366/304 |
| 1234254 | 6/1971 | United Kingdom . | |
| 2040177A | 8/1980 | United Kingdom . | |
| 2040177 | 8/1980 | United Kingdom | 366/157 |
| 330877 | 12/1972 | U.S.S.R. . | |
| 0709148 | 1/1980 | U.S.S.R. | 366/157 |

*Primary Examiner*—Philip R. Coe
*Assistant Examiner*—Frankie L. Stinson
*Attorney, Agent, or Firm*—Stevens, Davis, Miller & Mosher

[57] ABSTRACT

The present invention relates to a process and a device for the preparation of fine and uniform dispersions of a divided product in a liquid. A powder and a liquid are fed at a constant flow rate into the device at separate points, and are instantaneously and independently brought up to speed and then brought into contact with each other in a dynamic manner. The process is carried out by means of a turbine composed of at least two non-continuous parts which do not allow the products to return to the center of the turbine, two separate pipes, namely a feed pipe for the powder and a feed pipe for the liquid, and a discharge pipe for the dispersion. The invention applies particularly to liquids possessing a high solvating power with respect to the powders with which they are to be mixed.

2 Claims, 3 Drawing Figures

DEVICE FOR THE PREPARATION OF DISPERSIONS

Figure 1:
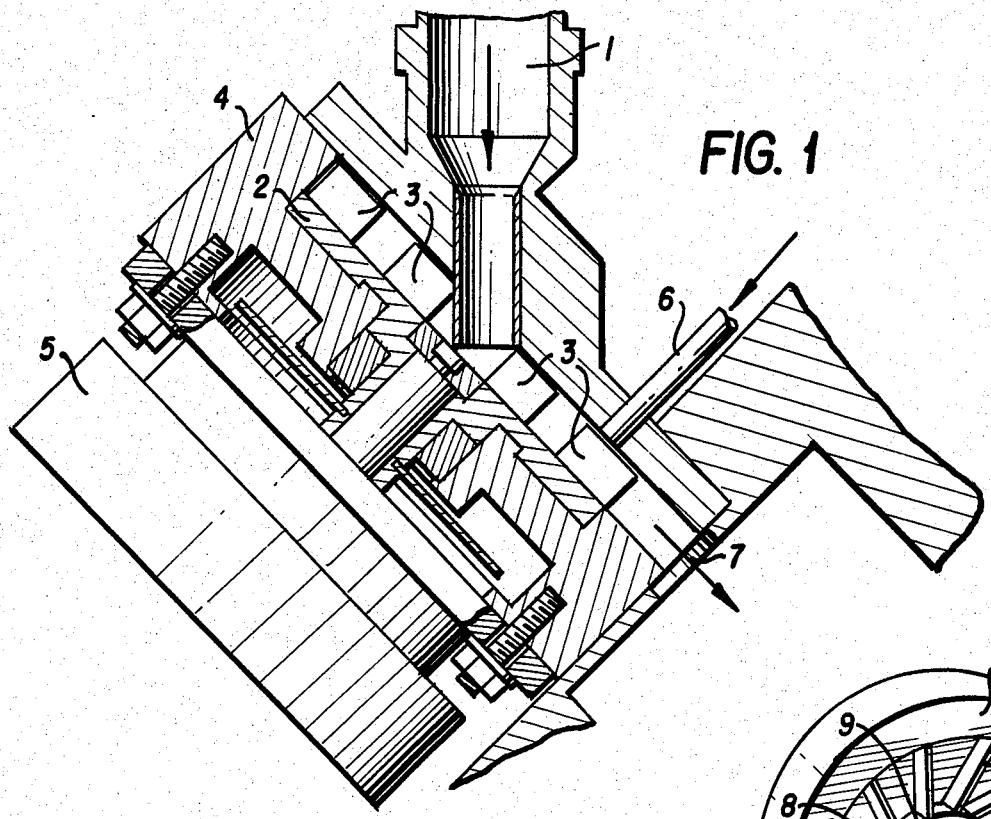

This application is a continuation of Ser. No. 229,504, filed Jan. 29, 1981.

The present invention relates to a process and a device for the continuous preparation of fine dispersions.

In particular, it relates to a process and a device for the preparation of dispersions of a divided product, in the form of powder, in a liquid.

It applies particularly to liquids possessing a high solvating power with respect to the powders with which they are to be mixed, for example polymers in the form of powder.

For example, the dissolution of certain polymers which can be spun in solution presents great difficulties, wherefore it is easier, in a first stage, to disperse them under conditions which are such that dissolution does not take place before they are dispersed; this makes it possible to avoid the formation of lumps or even the solidification of the powder and the liquid.

Thus, hitherto, the dissolution of powdered polyvinyl chloride in the solvent mixture acetone/carbon disulphide required malaxation for several hours in a malaxator and had necessarily to be carried out discontinuously; furthermore, the resulting mixture lacked homogeneity and this disadvantage had significant repercussions on the quality of the resulting spun filaments.

Attempts have also been made to prepare dispersions, in accordance with the process described in French Application No. 2,250,564, by initially forming a liquid jet within the liquid in which the powder is to be dispersed, by introducing the powder into the liquid jet, and by then atomising the liquid jet containing the powder.

However, such a process is not suitable for the preparation of dispersions of certain polymers, such as those of polyvinyl chloride in the solvent mixture acetone/carbon disulphide, because the polymer and the solvent solidify, totally blocking the apparatus.

In accordance with the present invention, a process and a device have now been found which are even suitable for the preparation of dispersions of certain polymers which could not be dispersed uniformly hitherto, such as polyvinyl chloride.

The present invention relates to a process for the continuous preparation of fine and uniform dispersions, characterized in that:

the powder and the liquid are fed at a constant flow rate into the mixing device at separate points, the two components are independently and instantaneously caused to move at high speed, and they are then brought into contact with one another whilst they are moving at high speed.

In general, in order to prepare uniform dispersions continuously, the powder is preferably fed into the mixing device by gravity. Preferably, the powder is fed in at the center of the mixing apparatus, whilst the liquid is fed in at the external part of the same apparatus.

In order to prepare dispersions of powder in a liquid having a high solvating power with respect to the powder, the contact time inside the device is preferably as short as possible, namely of the order of a millisecond. This time must be the shorter, the higher is the solvating power of the liquid with respect to the powder.

In the same manner, it is also preferable for the solvent and the powder to be fed in at respective temperatures which are such that the solvating power is as low as possible during the operation, in order to avoid the risks of clogging.

The present invention also relates to a device for the preparation of fine dispersions, which comprises a turbine comprising at least two non-continuous parts which do not allow the products to return to the center of the said turbine, a feed pipe for the powder and a feed pipe for the liquid, at separate points, and a discharge pipe for the dispersions. Preferably, the discharge pipe is located tangentially relative to the turbine.

It is also preferable for the two non-continuous parts to consist of at least two rows of blades and for the feed pipe for the powder to emerge in the central part of the turbine, whilst the feed pipe for the liquid emerges at the external part of the latter.

Preferably, the plane of the turbine is inclined in order to assist the flow of the dispersions.

It is also preferable for the feed pipe for the powder to be inclined so that the latter arrives by gravity.

The essential characteristic of the process according to the present invention is the fact that the powder and the liquid are brought into contact in a dynamic manner and at high speed. For this purpose, they must be fed in at separate points and brought up to speed separately, before being brought into contact.

A process of this type is even suitable in the case of liquids possessing a high solvating power with respect to the powder which is intended to be dispersed in the said liquid.

It is particularly suitable for the preparation of dispersions of polyvinyl chloride in a solvent such as the mixture carbon disulphide/acetone. The dispersions thus obtained are fine and uniform, so that the solutions resulting therefrom can then be spun comtinuously, without difficulty, to give filaments and fibers which are also of uniform composition. Furthermore, the actual dissolution can be carried out more rapidly and more easily, so that the energy required for the preparation of the solutions is greatly reduced.

Finally, this process makes it possible to prepare dispersions which are more concentrated than those normally used, and this also permits a saving in terms of the amount of solvent used. The concentration limit is determined by that viscosity of the resulting products beyond which they can no longer be conveyed.

Figure 3:
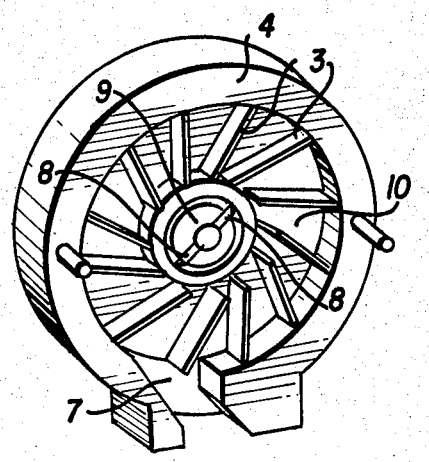
Figure 2:
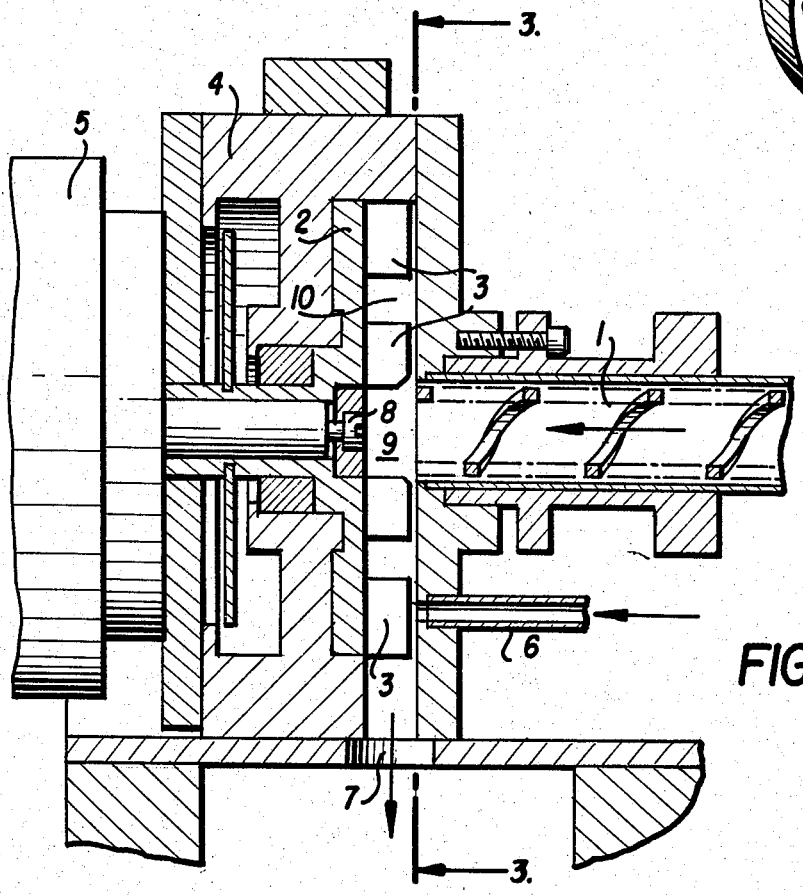

The manner in which the process according to the invention is carried out will be understood still more clearly with the aid of the accompanying FIGS. 1 2 and 3 which constitute illustrative but non-limiting embodiments of the device according to the invention.

According to FIG. 1, the polyvinyl chloride powder is conveyed by gravity through the pipe 1 arriving at the center of the turbine 2, and is then immediately brought up to speed by centrifugal force by means of the blades 3. The solvent is conveyed separately by means of a tube 6 located perpendicularly relative to the plane of the turbine. The solvent arrives at the external set of blades and is then immediately caused to move, the powder and the solvent coming into contact, at speed, at the external part of the turbine 2. The latter is inserted in a part 4 and is actuated by means of the motor 5. The turbine is inclined at 45° relative to the horizontal. The dispersion leaves the turbine 2 tangentially by means of the pipe 7 and the dispersion is collected by gravity.

FIG. 2 shows a slightly different embodiment according to the invention. It comprises a pipe 1 fitted with an endless screw, which pipe is located horizontally and feeds the polymer powder into the center of the turbine 2 fitted with blades 3, making it possible to bring the polymer powder up to speed in the external part of the turbine. The pipe 6 permits the direct introduction of the solvent onto the external blades of the turbine, the two products being dispersed instantaneously by the turbine 2 actuated by the motor 5. The resulting dispersion leaves the turbine tangentially, by gravity, by means of the pipe 7. Reference numeral 8 shows the central blades, i.e., the "winged screw" referred to below in Example 1. Reference numeral 9 denotes the central part of the turbine, while reference numeral 10 denotes the outermost part of the turbine.

In FIG. 3, there can be seen the two rows of blades, which prevent the product from returning to the center of the turbine, one row 8 comprising only 2 blades, and the other row of blades 3, situated in the outer part of the device. The discharge duct 7 can be also seen which is not really a pipe but simply a duct through the frame 4 of the turbine.

The process and the device according to the present invention make it possible to prepare, in a very short period of time which can be as short as a few milliseconds, fine and uniform dispersions, the concentration of which can vary in accordance with the viscosity of the said dispersions and with their ability to be conveyed. For the particular case of dispersions of powdered polyvinyl chloride in the solvent mixture carbon disulphide-/acetone (50/50 by volume), the polymer concentration of which is 28 to 30% by weight, it even proves possible to prepare dispersions by introducing the solvent mixture at ambient temperature, this being of significant economic value.

The examples which follow are given by way of indication in order still further to illustrate the invention.

EXAMPLE 1

The device as shown in FIG. 2 is used. It is caused to rotate continuously for 100 hours, whilst introducing the polyvinyl chloride powder into the center of the turbine at a flow rate of 45 kg/hour, via a metering screw, and introducing the solvent mixture carbon disulphide/acetone (50/50 by volume), kept at about 2° C., onto the outside of the turbine at a rate of 115 liters/-hour.

The apparatus, which has an internal diameter of 12 cm, comprises an external row of 12 blades inclined at 30°. The central blades simply consist of a winged screw, i.e., a kind of screw with two blades. The rotation speed of the turbine is 3,000 rpm and the dispersion is produced in a period of time of about 5 milliseconds, at a rate of 160 kg/hour.

The polyvinyl chloride dispersion thus obtained is collected in a tank and can be used continuously in subsequent treatment stages in the usual manner.

EXAMPLE 2

Polyvinyl chloride powder and the same solvent mixture carbon disulphide/acetone, at ambient temperature, are introduced separately, at respective rates of 60 kg/hour and 160 kg/hour, into the turbine used in Example 1. The polyvinyl chloride dispersion was produced continuously at a flow rate of 220 kg/hour for 5 hours, directly at ambient temperature.

What is claimed is:

1. A device for the continuous preparation of fine and uniform dispersions of a powdered polymer, based on vinyl chloride, in a solvent therefor, characterized in that it comprises:

an inclined turbine consisting essentially of at least two rows of blades which prevent the dispersion from returning to the center of the turbine, one row being exactly situated around the center of the turbine and the other being in the outermost part of the turbine, the two rows of blades being separated by a relatively small circular space, a feed pipe for powder and a feed pipe for liquid located at separate points on the said turbine, and respectively on each part of the turbine, corresponding to the rows of blades, each of the feed pipes being used for a single constituent, the feed pipe for the powder emerging in a central zone of the turbine on one row of blades and the feed pipe for the liquid emerging at the external part of the turbine on the other row of blades, a discharge duct for the dispersion being located tangentially with respect to the turbine at the level of the outer blades, whereby the turbine does not need grinding means and scrapers.

2. A device as defined in claim 1, wherein the said polymer is polyvinyl chloride.

* * * * *